US006371810B1

(12) United States Patent
Iwasaki

(10) Patent No.: US 6,371,810 B1
(45) Date of Patent: Apr. 16, 2002

(54) SHIELDED CONNECTOR ARRANGEMENT HAVING INNER AND OUTER SHELLS

(75) Inventor: Masaaki Iwasaki, Kanagawa (JP)

(73) Assignee: Tyco Electronics, AMP, K. K., Kanagawa (JP)

( * ) Notice: Subject to any disclaimer, the term of this patent is extended or adjusted under 35 U.S.C. 154(b) by 0 days.

(21) Appl. No.: 09/698,547

(22) Filed: Oct. 27, 2000

(30) Foreign Application Priority Data

Oct. 29, 1999 (JP) ..... 11-308512

(51) Int. Cl.[7] ..... H01R 13/648
(52) U.S. Cl. ..... 439/607
(58) Field of Search ..... 439/607, 610, 439/76.1

(56) References Cited

U.S. PATENT DOCUMENTS 4,678,121 A 7/1987 Douty et al. ..... 439/610
4,718,866 A 1/1988 Yamaguchi ..... 439/607
5,171,167 A 12/1992 Kosmala ..... 439/607
5,567,169 A * 10/1996 McCleerey et al. ..... 439/181
5,836,774 A 11/1998 Tan et al. ..... 439/76.1
6,139,365 A * 10/2000 Lok ..... 439/607
6,227,910 B1 * 5/2001 Huang ..... 439/610

FOREIGN PATENT DOCUMENTS

JP HEI 64-38866 2/1964

* cited by examiner

*Primary Examiner*—Brian Sircus
*Assistant Examiner*—Chandrika Prasad

(57) ABSTRACT

The shielding arrangement of the present invention is equipped with a conductive inner shell (10) that has opening (11) for receiving a mating connector (40), and an outer shell (20) that encloses parts of inner shell (10). The outer shell serves to resist outward force applied by the inserted mating connector to the inner shell during mating by having bent sections (22) extending inward near an edge to engage the conductive inner shell (10).

5 Claims, 3 Drawing Sheets

SHIELDED CONNECTOR ARRANGEMENT HAVING INNER AND OUTER SHELLS

FIELD OF THE INVENTION

The present invention relates to electrical connectors and more particularly to a shielding arrangement for such connectors.

BACKGROUND

Shielded connectors having a shield member surrounding the housing and protecting signals from ambient electromagnetic noise are known. During mating of such connectors, the shield members generally contact each other to establish a common potential between them.

Known examples in the prior art include shielded connectors that have a plurality of contacts in a housing surrounded by a single shield member. The single shield member typically has an opening at an end into which the shield member of a mating shielded connector is inserted. Another known shielding arrangement places projections on the inner circumference of an opening in shield members for engaging the mating shielded connector is inserted to achieve point contact at a plurality of locations on the shield member of the mating shielded connector (see Utility Model HEI 1-38866). These projections serve to fasten the engaged shield members which is thought to increase the reliability of the electrical contact between them.

With the ongoing development of computer technology comes a need for greater signal density through such connectors as well as the need for increasing signal transfer rates. As the size of these multi-contact connectors increases the openings that receive the complementary shield member increase accordingly. After repeated mating cycles these large openings tend to stretch because of the outward force applied by the projections described above. The result is that movement occurs between the mated connectors causing intermittent electrical contact at the signal and/or shielding connections.

The intermittent contact along the shield member may only occur at certain locations along the opening. This causes current to pass over the shield at the contacting sections and to be blocked at those sections with poor or no contact thus reducing the electromagnetic interference protection. In applications where the shield is grounded, the ground path will become long due to detours of the conduction path caused by the poor or non contacting sections, which may affect the fall of pulse signals and impede high-speed signal transmission.

SUMMARY

The object of this invention is to provide a shielded connector arrangement having improved electrical contact between the shield members of mated connectors.

This and other objects are achieved by providing a shielded connector that has a plurality of signal contacts and a shielding shell that engages a mating connector. The shielding shell being equipped with a conductive inner shell which receives the mating connector is inserted and an outer shell that supports the inner shell. The outer shell serves to prevent the inner shell from expanding due to the insertion of the mating connector.

BRIEF DESCRIPTION OF THE DRAWINGS

The invention will now be described by way of example with reference to the accompanying figures of which.

DETAILED DESCRIPTION OF THE PREFERRED EMBODIMENT

Figure 1:
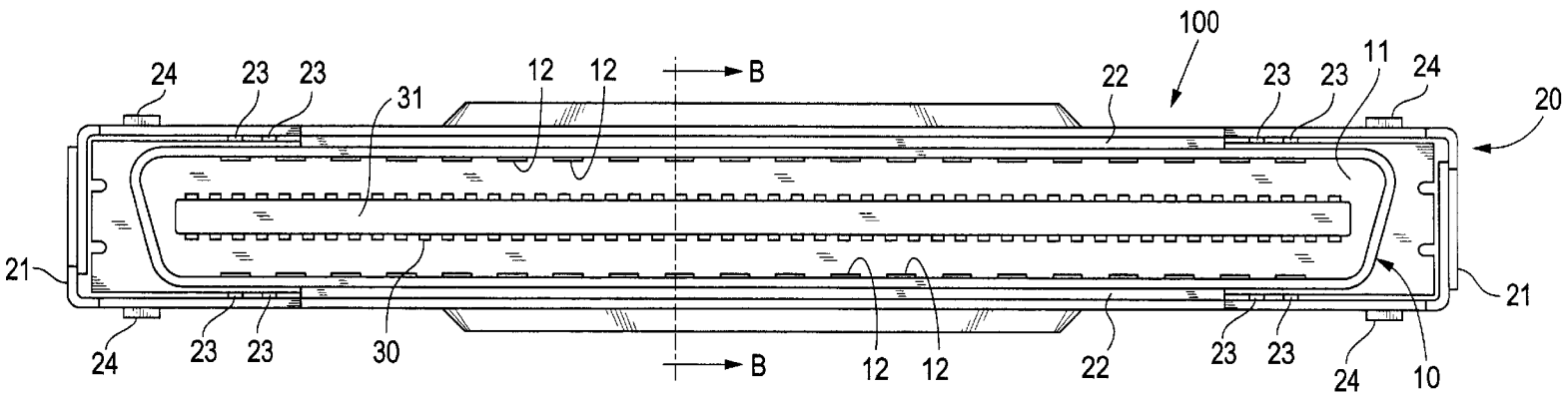
FIG. 1(A) is a front view of the shielded connector.
FIG. 1(B) shows a B—B cross-section diagram of the shielded connector of FIG. 1(A).
Figure 1:
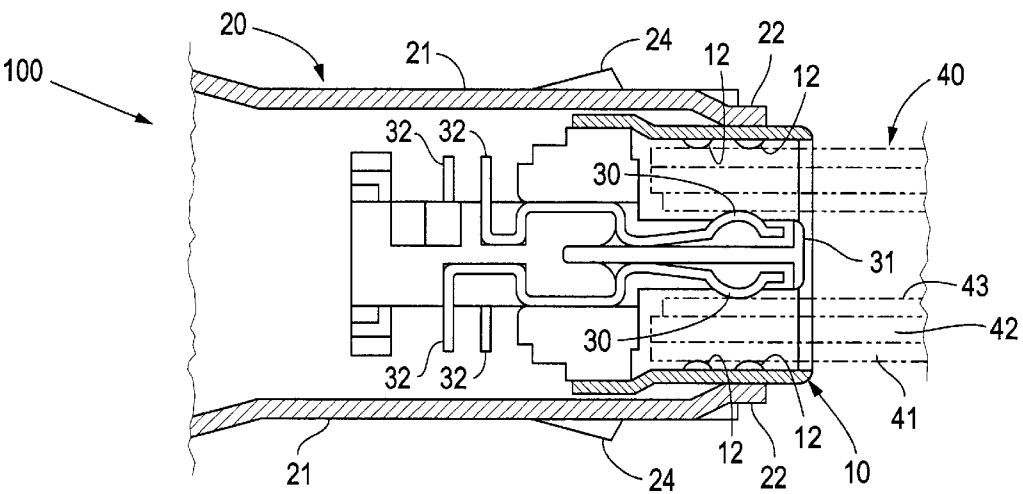

The invention will first be described generally with reference to FIG. 1. Shielded connector 100 has an inner shell 10 and an outer shell 20. Contacts 30 are disposed inside the inner shell 10. In the preferred embodiment, the contacts 30 are male, and 50 of them are installed along the top and bottom in insulating housing 31. Furthermore, contacts 30 are equipped with terminals 32 which are connected to the conductors (not shown) of shield wires 60 (see FIG. 2).

As the two dotted lines in FIG. 1(B) show, mating connector 40 includes contacts 43 on housing 42. The outer circumference of the mating connector 40 is formed by shield member 41, and the contacts 43 are matable with contacts 30 of shielded connector 100. Mating connector 40 has tines 44 (see FIG. 2) with which contacts 43 connect on a circuit board (not shown).

Shielded connector 100 is preferably covered by a pair of insulating members that extend over the outer shell 20. The pair of insulating members serve to prevent shocks to the user and serve as mounts for jack screws. The shielded connector 100 is shown in FIG. 2 as being covered by insulating member 50 only on its bottom side for purposes of explanation, and jack screws 51 are located opposite ends.

Figure 2:
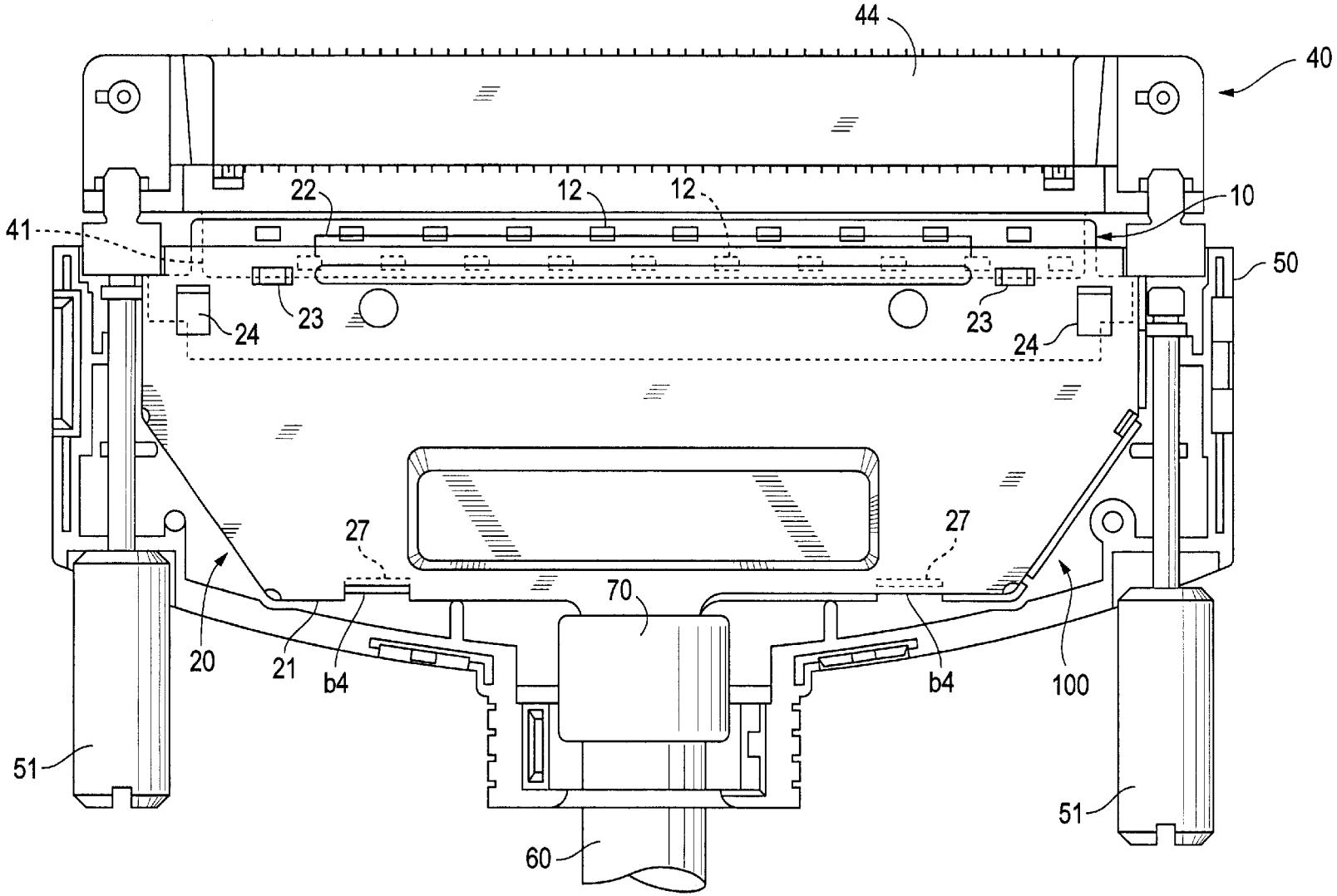
FIG. 2 is a plan view that shows the shielded connector of FIG. 1 mated with a complementary mating connector.

The rear end of shielded connector 100 shown in FIG. 2 is designed to secure a shielding braided wire (not shown) of shield wire 60 with a conductive holding member 70 which makes electrical contact with outer shell 20.

Inner shell 10 is formed in a tube-shape from a single piece and has an opening 11 as shown in FIG. 1(A). A plurality of projections 12 extend along the circumference of inner shell 10 for engaging the outer circumference surface of shield member 41 of mating connector 40. The projections 12 are disposed in two columns along the length in a zigzag pattern (see FIG. 2).

Outer shell 20 is disposed on the outer side of inner shell 10, and formed of a pair of shell members 21 which are preferably of the same shape and size. As shown in FIG. 1(A) they are fastened to each other such that their sides overlap from above and below. As shown in FIG. 1(B), integral bent sections 22 extend along the outer shell 20 toward the inside facing the outer circumference surface of inner shell 10. These bent sections 22 engage the inner shell 10 near the projection to prevent expansion due to the insertion of mating connector 40.

The force exerted on the inside of inner shell 10 by insertion of mating connector 40 is distributed across projections 12 over a large area. Furthermore, since shielded connector 100 is relatively wide there is a danger that the electrical contact with shield member 41 of mating connector 40 will be broken near the center parts of the inner shell 10. Moreover, while inner shell 10 could be formed with a plate thickness that has sufficient strength to endure the outward force from the inner side that it receives due to insertion of mating connector 40, the shape of the inner shell is often restricted by standards. Also, the bends required to form the inner shell become problematic as the material thickness is increased.

Optionally, in addition to the bent sections 22 formed as a single piece with outer shell 20, the thickness of the outer shell 20 itself may be increased to withstand the force exerted by the inner shell 10. As another option, a separate piece may be used to reinforce the outer shell 20. These bent sections 22 serve to realize the shortest ground path in shielded connector 100 which extends through projections 12 and the outer circumference surface of shield member 41 of mating connector.

Outer shell 20 has projections 23 located on the inner side of bent sections 22 that project toward inner shell 10 as shown in FIG. 1(A) and FIG. 2. The inner shell 10 and outer shell 20 are properly positioned using these projections 23. Joining projections 24 located in the four corners of the outer shell 20 extend toward a groove in the insulation member 50 for positioning it with insulation member 50 (see FIG. 2).

Figure 3:
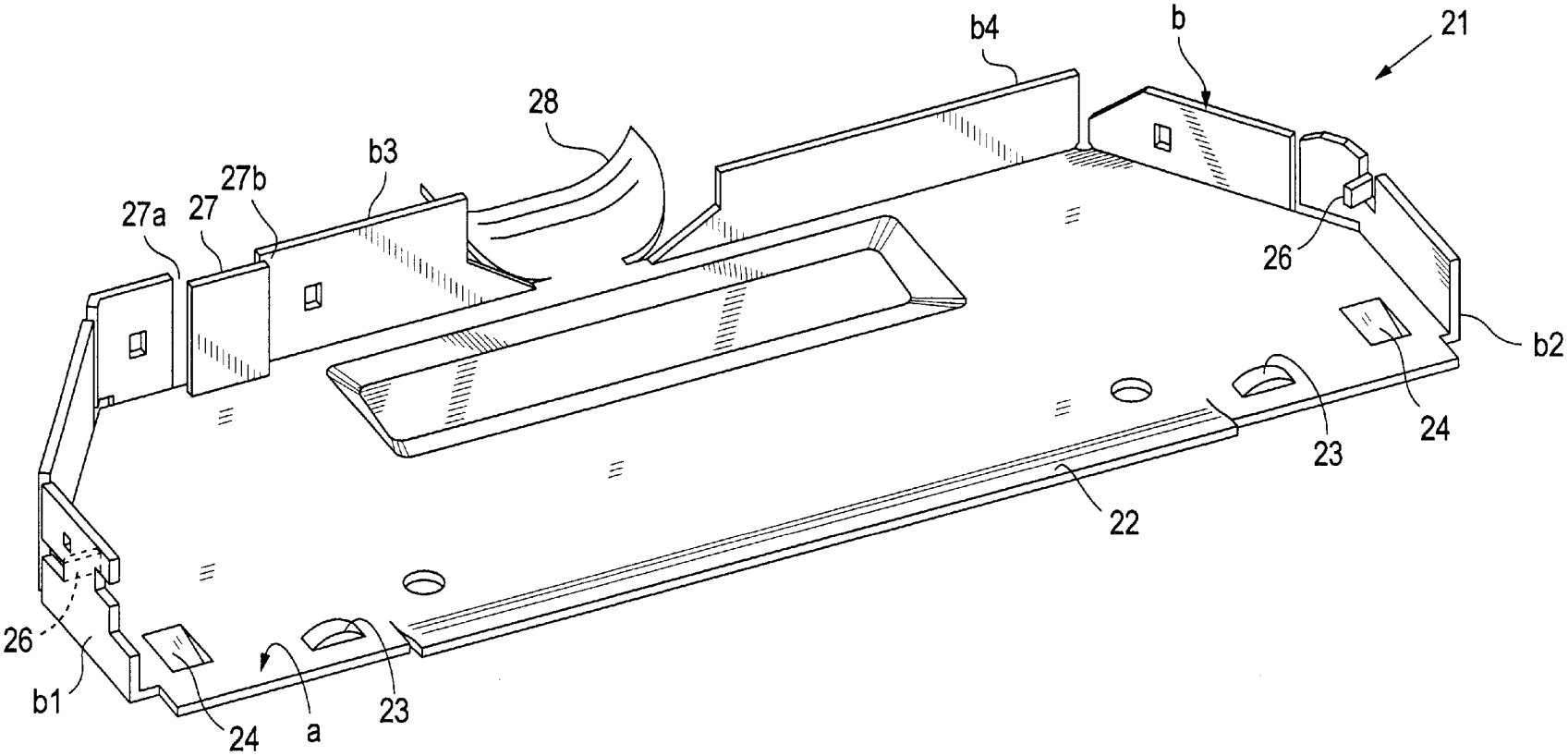
FIG. 3 is a perspective view of the shell member utilized in the connector of FIGS. 1 and 2.

Referring now to FIG. 3, shell member 21 includes a horizontal plate "a" having the bent section 22, projection 23, joining projection 24, and side wall "b". Side wall "b" is upright so that it connects with one end of the periphery of horizontal plate "a". The other end of side wall "b" is left free.

This shell member 21 is formed from a single sheet metal plate and is equipped with cuts from the end left free to horizontal plate "a" in the parts of side wall "b" that correspond to transition points for bending.

The outer shell 20 that engages shell members 21 is also formed of a single sheet of metal in and may have a plate thickness which is thicker than inner shell 10. Accordingly the bent sections, 22 formed as a single unit with outer shell 20 are stronger than inner shell 10 and can better withstand the force that the inner shell 10 bears due to the engagement with the mating connector 40.

As a reference for the center in the direction of length of horizontal plate a, rear left side wall "b3" and rear right side wall "b4" are offset front to back relative to one another. In other words, in FIG. 3, rear right side wall "b4" is erected in front of rear left side wall "b3" and is connected to horizontal plate "a". Furthermore, rear left side wall "b3", which is positioned off from the center has a raised section 27 formed out of it by cutting and raising. Stops 26 for positioning housing 31 are formed on left side wall "b 1" and right side wall "b2" projecting into their respective interiors (also see FIG. 1).

Outer shell 20 is assembled by facing the edges of free side walls "b" toward each other and engaging the two shell members shown in FIG. 3. In the engagement of these shell members 21 with each other, raised section 27 is joined to the mating shell member on it's rear right side wall "b4" (also see FIG. 2). This raised section 27 engagement with the rear right side wall "b4" is intended both to make the engagement of shell members 21 with each other more secure and to create electrical contact between shell members 21. Accordingly, it reliably maintains the same electric potential over the entire outer shell 20. Once the outer shell is assembled, the bent sections 22 are positioned over the projections 12" at the end of the line.

Furthermore, in the engagement of shell members 21 with each other, outer shell 20 can be maintained at a predetermined thickness by having it touch and connect with stop 26, which is installed on the shell member that engages stop 26 (see FIG. 1 (A)).

In the shell member 21, braid receiving section 28, which covers half the circumference of the shielding wire braid (not shown) of shield wire 60, is installed between rear left side wall "b3" and rear right side wall "b4". The entire circumference of the wire braid (not shown) is therefore covered by the braid receiving sections 28 upon assembly of shell members 21 with each other.

Advantageously, the shielded connector 100 is equipped with a plurality of projections 12 that project to the interior of inner shell 10, and supports the exterior surface of inner shell 10 with the tip of outer shell 20, which has a plate thickness that is preferably thicker than inner shell 10. Accordingly, the force that inner shell 10 is subjected to from the inner side by the insertion of mating connector 40 is borne by outer shell 20, and the expansion of the central part of inner shell 10 is prevented. As a result, the shielded connector 100 can increase the reliability of electrical contact between inner shell 10 and shield member 41 of mating connector 40, and can also increase the reliability of electrical contact between inner shell 10 and outer shell 20. Moreover, since outer shell 20 of the present working configuration is formed by engaging shell member 21 of the same shape, only one dye is needed, enabling manufacturing costs to be kept down and facilitating part management. Since shell members 21 are joined to each other by raised portions 27, the reliability of electrical contact between shell members 21 is increased.

While the invention has been described utilizing in view of preferred embodiments, variations that are within the spirit of the invention will, be apparent to those skilled in the art. For example, projections 12 installed on the inner circumference of inner shell 10 may also be installed on the outer circumference surface of the mating connector to be engaged, or may be installed on both, and their shape may be dimple-like bumps rather than projections as shown in the drawings. The invention is therefore intended to be limited only by the appended claims.

What is claimed is:

1. A shielding arrangement for an electrical connector comprising:

a conductive inner shell that has an opening for receiving a mating connector;

a conductive outer shell that lies over the inner shell and comprises a pair of shell members of the same shape that extend along a length of the conductive inner shell; and, raised sections positioned along the outer shell for joining the shell members to each other.

2. The shielding arrangement of claim 1 wherein the conductive inner shell further comprises projections extending inward to a mating connector.

3. The shielding arrangement of claim 2 wherein the projections are arranged in a zig zag pattern along the periphery of the conductive inner shell.

4. The shielding arrangement of claim 1 wherein the conductive outer shell further comprises a braid receiving section disposed at a rear end.

5. The shielding arrangement of claim 4 wherein a ground circuit extends from the braid through the conductive outer shell to the conductive inner shell by the engagement of the bent sections with the conductive inner shell.

* * * * *